US007131257B2

(12) United States Patent
Miyazaki et al.

(10) Patent No.: US 7,131,257 B2
(45) Date of Patent: Nov. 7, 2006

(54) METAL CORD AND PNEUMATIC TIRE INCLUDING THE SAME

(75) Inventors: Shinichi Miyazaki, Kobe (JP); Osamu Toda, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 376 days.

(21) Appl. No.: 10/301,687

(22) Filed: Nov. 22, 2002

(65) Prior Publication Data

US 2003/0116248 A1 Jun. 26, 2003

(30) Foreign Application Priority Data

Nov. 22, 2001 (JP) ..... 2001-358054

(51) Int. Cl.
*D02G 3/02* (2006.01)

(52) U.S. Cl. ..... 57/236; 57/311

(58) Field of Classification Search ..... 57/236, 57/237, 239, 311, 314, 902; 152/451, 527, 152/556–558; 474/237
See application file for complete search history.

(56) References Cited

U.S. PATENT DOCUMENTS

| | | | | |
|---|---|---|---|---|
| 3,273,978 | A | 9/1966 | Paul | |
| 5,020,312 | A | 6/1991 | Watakabe | |
| 5,968,651 | A | 10/1999 | De Vos et al. | |
| 6,099,797 | A | 8/2000 | Bhagwat et al. | |
| 6,102,095 | A | 8/2000 | Obana et al. | |
| 6,109,017 | A * | 8/2000 | Kawatani | 152/527 |
| 6,805,178 | B1 * | 10/2004 | Miyazaki et al. | 152/556 |

FOREIGN PATENT DOCUMENTS

| | | | |
|---|---|---|---|
| EP | 0 644 070 | A1 | 3/1995 |
| EP | 0 672 546 | A1 | 9/1995 |
| EP | 0 976 583 | A2 | 2/2000 |
| EP | 1 010 548 | A2 | 6/2000 |
| EP | 1 125 768 | A2 | 8/2001 |
| JP | 5-345503 | A | 12/1993 |
| JP | 11-11107 | A | 1/1999 |

* cited by examiner

*Primary Examiner*—Shaun R. Hurley
(74) *Attorney, Agent, or Firm*—Birch, Stewart, Kolasch & Birch, LLP

(57) ABSTRACT

A metal cord for reinforcing rubber articles and a pneumatic tire including metal cords to reinforce tire components such as carcass, breaker and band are disclosed, wherein a metal cord according to one aspect of the present invention comprises filaments having a tensile strength of from 4000 to 5500 N/sq.mm and a diameter of from 0.10 to 0.35 mm and the filaments are twisted together, the filaments before twisted are two-dimensionally waved so that the elongation after fracture of the cord becomes in a range of from 2 to 6%. According to another aspect of the present invention, the metal cord is a single filament having a tensile strength of from 4000 to 5500 N/sq.mm and a diameter D of from 0.10 to 0.35 mm, and the filament is two-dimensionally waved so that the elongation after fracture becomes in a range of from 2 to 6%.

6 Claims, 3 Drawing Sheets

METAL CORD AND PNEUMATIC TIRE INCLUDING THE SAME

BACKGROUND OF THE INVENTION

The present invention relates to a metal cord for reinforcing rubber articles and a pneumatic tire including metal cords to reinforce tire components such as the carcass, the breaker and the band.

In recent years, from the viewpoint of protection of the environment, there is a pressing need to reduce the weight of automobile tires because the tire weight reduction may decrease the rolling resistance and improve the fuel consumption of the automobiles. Therefore, every effort to reduce the tire weight has been made on various tire components.

For example, in case of steel cords used to reinforce pneumatic tires, effort to increase the strength of a cord is made in order to decrease the total weight of steel cords used in a tire. Therefore, we tried to increase the strength of steel filaments constituting a steel cord, using various materials for example a wirebar made of a high-carbon steel whose carbon content is in a range of from 0.90 to 1.0 weight % or a low-alloy steel including chromium, and changing the wire drawing conditions so as to be able to uniformize heat the generation during drawing and the amount of processing to the drawn wire or filament, and further changing the thermal treatment process. As a result, there is hope for desired high-strength filaments.

In such high-strength steel filaments, however, the resistance to fatigue is not good. It is difficult to improve the fatigue resistance at the same time by the process which is capable of improving the tensile strength.

SUMMARY OF THE INVENTION

It is therefore, a primary object of the present invention to provide a high-strength metal cord which is improved in fatigue resistance and thereby is suitably used to reinforce rubber articles such as pneumatic rubber tires for the purpose of reducing the gross weight of the article.

Another object of the present invention is to provide a pneumatic tire in which the high-strength metal cords are used to decrease the tire weight.

According to one aspect of the present invention, a metal cord comprises filaments, each having a tensile strength of from 4000 to 5500 N/sq.mm and a diameter of from 0.10 to 0.35 mm, and twisted together, wherein the filaments are, before twisted, two-dimensionally waved so that the elongation after fracture of the cord becomes in a range of from 2 to 6%.

According to another aspect of the present invention, a metal cord is a single filament having a tensile strength of from 4000 to 5500 N/sq.mm and a diameter D of from 0.10 to 0.35 mm, and the filament is two-dimensionally waved so that the elongation after fracture becomes in a range of from 2 to 6%.

According to the present invention, a pneumatic tire includes the above-mentioned metal cords as reinforcing cords such as belt cords, carcass cords and bead reinforcing cords.

BRIEF DESCRIPTION OF THE DRAWINGS

Embodiments of the present invention will now be described in detail in conjunction with the accompanying drawings, wherein.

DETAILED DESCRIPTION OF THE INVENTION

Figure 1:
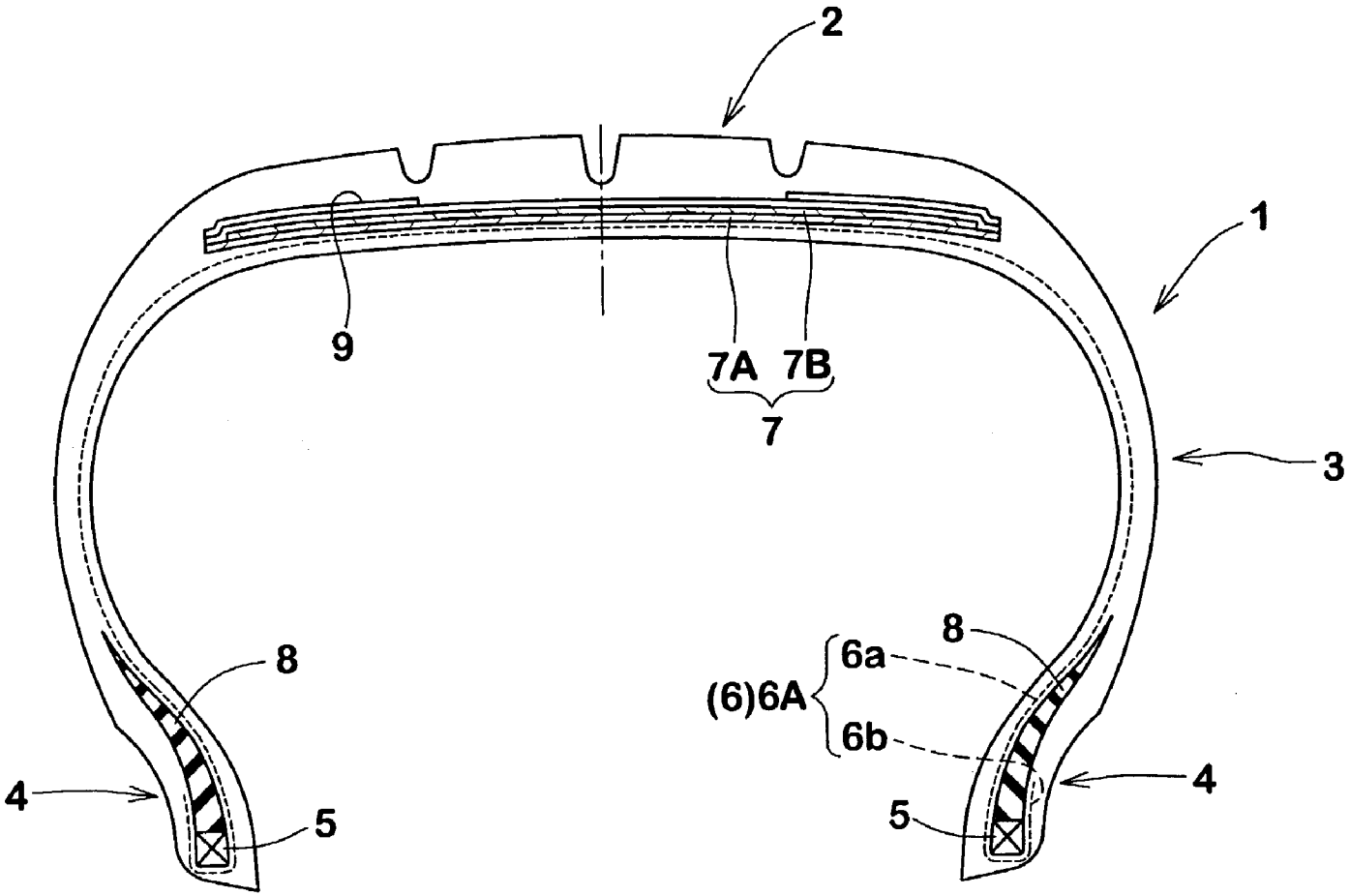
FIG. 1 is a cross sectional view of a pneumatic tire according to the present invention.

In FIG. 1, a pneumatic tire 1 according to the present invention incorporates a tread portion 2, a pair of sidewall portions 3, a pair of bead portions 4, each with a bead core 5 therein, a carcass 6 extending between the bead portions 4, and a tread reinforcing belt (7, 9) disposed outside the carcass 6 in the tread portion 2.

The pneumatic tire 1 in this example is a radial tire for passenger cars.

The carcass 6 comprises at least one ply 6A of cords arranged radially at an angle of from 75 to 90 degrees with respect to the tire equator. The carcass ply 6A comprises a main portion 6*a* and a pair of turned up portions, wherein the main portion 6*a* extends between the bead cores 5 in the bead portions 4 through the tread portion 2 and sidewall portions 3, and each of the turned up portions 6*b* is turned up around the bead core 5 in one of the bead portions 4 from the inside to the outside of the tire.

In this example, organic fiber cords such as nylon, rayon, polyester and the like are used as the carcass cords.

Each bead portion 4 is provided on the radially outside of the bead core 5 with a bead apex 8 made of hard rubber which extends radially outwardly between the main portion 6*a* and turned up portion 6*b*, while tapering towards its radially outer end.

The above-mentioned belt includes a breaker 7 and optionally band 9.

The breaker 7 comprises at least two-cross plies 7A and 7B (in this example only two plies) each made of parallel cords laid at an angle of from 10 to 35 degrees with respect to the tire equator.

The band 9 is disposed on the radially outside of the breaker 7 so as to cover at least the axial edges of the breaker 7 in order to provide a hooping effect on the breaker 7 to improve the high-speed durability of the belt. The band 9 is made of parallel cords or windings of at least one cord, wherein the cord angle is in the range of not more than 5 degrees with respect to the tire equator.

The belt in this example includes a band 9 which comprises a pair of axially spaced edge band plies made of a spirally wound organic fiber cord such as nylon.

In this embodiment, in order to reduce the tire weight by decreasing the weight of the breaker 7, a metal cord 10 is used as the above-mentioned breaker cords.

The metal cord 10 is made of at least one high-strength filament F.

The high-strength filament F is made by drawing a wirebar so as to have a diameter D of from 0.10 to 0.35 mm. As the metal material of the filament F, for example, a high-carbon steel whose carbon content is in a range of from 0.90 to 1.0 weight %, a low-alloy steel including chromium and the like are preferably used.

The tensile strength of the filament F is increased into a range of from 4000 to 5500 N/sq.mm, preferably 4500 to 5500 N/sq.mm by adjusting the conditions of drawing, thermal treatment and the like. Incidentally, the tensile strength of the filaments conventionally used to constitute a tire reinforcing steel cord is about 2400 to 2800 N/sq.mm. Thus, it may be said that the tensile strength of the filaments F used in this invention is very high.

The filament F is then two-dimensionally waved (hereinafter the "waved filament Fa").

The primary objective of the two-dimensional waving is to increase the elongation after fracture of the resultant metal cord 10 into a range of from 2 to 6% which is suitable for reinforcing the pneumatic rubber tires.

In case of the breaker cords or carcass cords, it is preferable that the number of all the waved filament(s) Fa in a metal cord 10 is not more than 12 including 1 (one). Thus, it is possible to use a single filament Fa as the metal cord 10.

Figure 2:
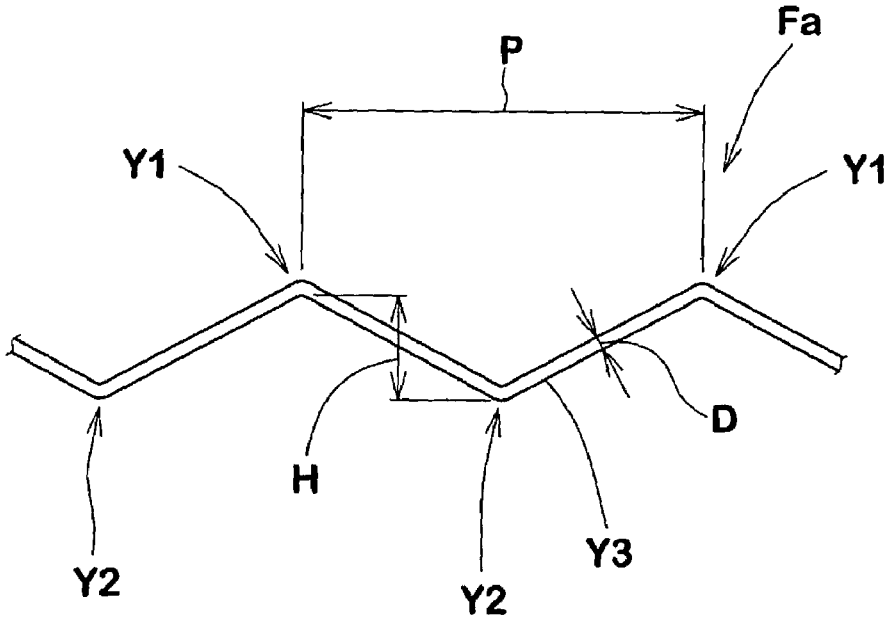
FIG. 2 shows a two-dimensionally waved filament for used to make a metal cord.

FIG. 2 shows an example of the two-dimensional wave on a filament, wherein the segments Y3 between the peaks Y1 and Y2 are straight. Thus, the wave can be said as a triangular wave. But, the two-dimensional wave may be a smooth curve consisting of curved segments Y3 such as sine curve and the like.

It is preferable that the wave pitch P between the peaks Y1 (or between the peaks Y2) is in a range of from 2.5 to 10.0 mm, and the wave height H between the peaks Y1 and Y2 is in a range of from 0.1 to 0.5 mm. (In FIG. 2, the wave height H is considerably exaggerated for the sake of clarity.)

Figure 3:
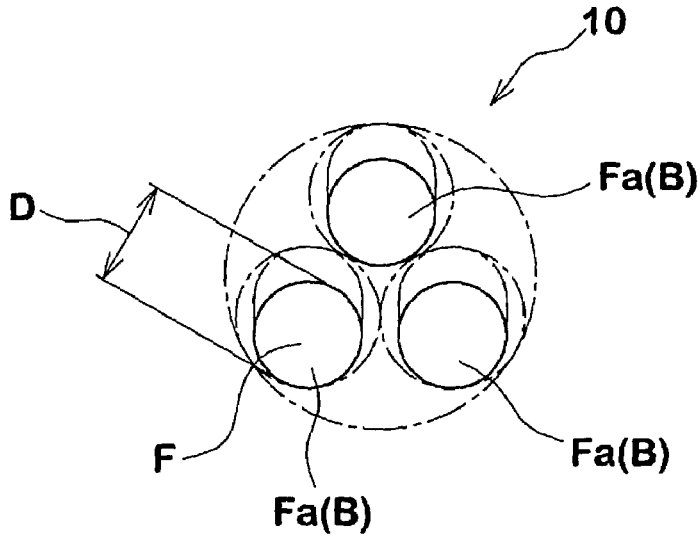
FIG. 3 is a schematic cross sectional view of a metal cord according to the present invention.
Figure 4:
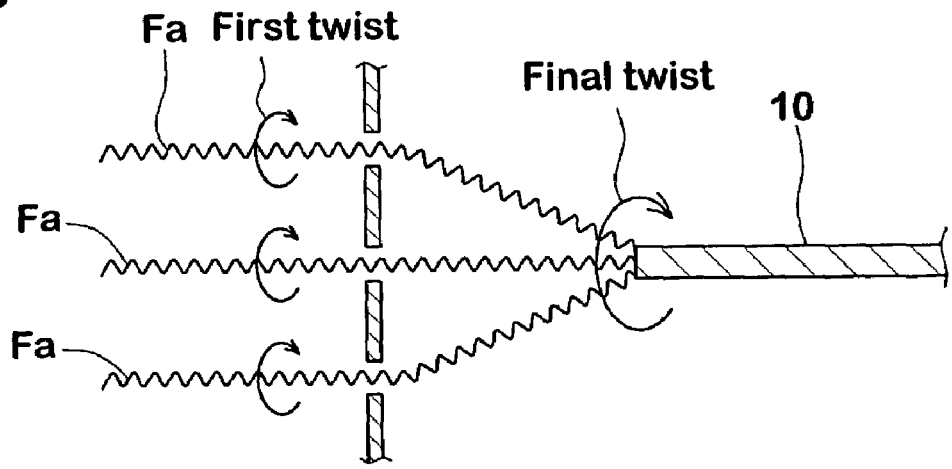
FIG. 4 is a diagram for explaining a method of making the metal cord shown in FIG. 3.

FIG. 3 shows an example of the metal cord 10 which is made up of three waved filaments Fa which are final-twisted together giving each filament a first-twist as shown in FIG. 4.

As the first-twist is given to the two-dimensionally waved filaments Fa, the filaments Fa display three-dimensionally waves in the finished cord. As a result, it becomes possible to achieve the elongation in the above-mentioned range by a minimum waving, and the possible damage to the filaments due to waving may be minimized to improve the durability of the cord.

Figure 5:
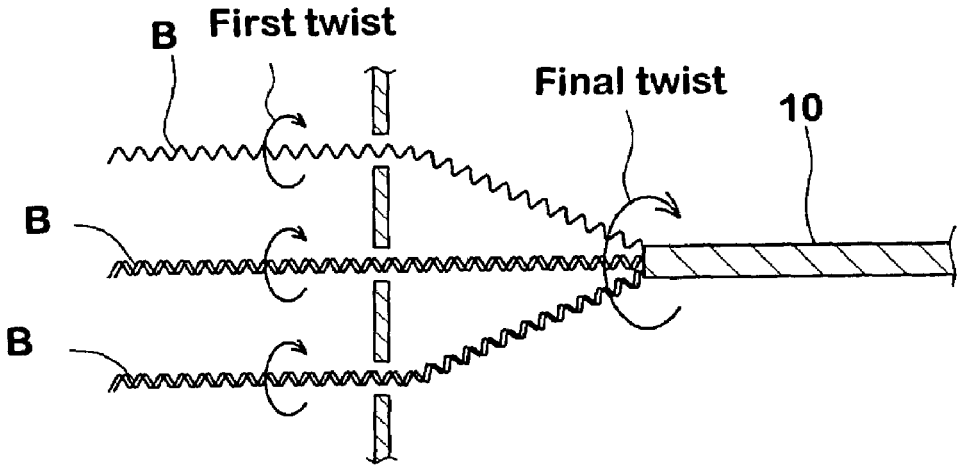
FIG. 5 is a diagram for explaining the method of making another metal cord.

In case the metal cord 10 is made up of a plurality of filaments, it is preferable that, the filaments Fa are divided into a plurality of groups B each group including one to four filaments Fa wherein a plurality of filaments Fa in a group are in a bundle without being twisted before it is not yet first-twisted, and the groups B are twisted together into a cord 10 (final twist) while twisting each group B (first twist) as shown in FIG. 5. FIG. 5 shows an example having one group B consisting of one waved filament and two groups B each consisting of two waved filaments.

In case of the above-mentioned example shown in FIG. 3 and 4, it can be said that the number of the groups B is three, and each group includes only one filament Fa.

Further, like a paralleled yarn, it is possible to bundle two-dimensionally waved filaments Fa into a metal cord without being twisted as far as the elongation after fracture of the cord becomes in a range of from 2 to 6%. The number of the filaments Fa is preferably not more than 12.

In any case, the final-twist pitch Pw is preferably set in a range of from 10 to 30 mm. The first-twist pitch Pn is set in a range of from 1 to 20 times, preferably more than 2 times the final-twist pitch Pw.

If the wave pitch P is more than 10.0 mm and/or the wave height H is less than 0.1 mm, as the wave is too small, it is difficult to obtain the required elongation of more than 2%. If the wave pitch P is less than 2.5 mm and/or the wave height H is more than 0.5 mm, the elongation becomes too large, and the damage to the filaments due to waving is liable to increase.

If the elongation after fracture is less than 2%, the durability of the cord decreases, and it becomes difficult to follow the elongation during building and vulcanizing the tire. If the elongation after fracture is more than 6%, as the elongation of the breaker 7 is increased, tire deformation during running increases and breaker edge separation is liable to occur.

If the filament diameter D becomes less than 0.10 mm, the strength of a filament marks a sharp decline, and it will be difficult to obtain the required strength for the cord.

On the other hand, if the filament diameter D becomes more than 0.35 mm, as the rigidity becomes too high, it is difficult to obtain the required elongation by the 2-D waving.

Comparison Tests

Test tires of size 195/65R15 for passenger cars having the same structure shown in FIG. 1 with the exception of the breaker cords were made and tested for durability. The specifications of the breaker cords are shown in Table 1.

The breaker was composed of two cross plies: one ply of the cords laid at +20 degrees and one ply of the cords laid at −20 degrees with respect to the tire equator.

The carcass was composed of a single ply of polyester fiber cords (1670 dtex/2) arranged at 89 degrees with respect to the tire equator.

The durability test was made, using a tire test drum. under 150% of the maximum tire load specified in the Japanese Industrial standard (JIS), 80% of the air pressure specified in JIS and a running speed of 80 km/h, the runable distance to breakage was measured.

The test results are shown in Table 1 by an index based on Ref. tire being 100, wherein the larger the index number, the better the durability.

In Table 1, the tire weight is indicated as the difference from Ref. tire.

TABLE 1

| Tire | Ex.1 | Ref.1 | Ref.2 | Ex.2 |
|---|---|---|---|---|
| Breaker ply | | | | |
| Cord count (/5 cm) | 40 | 40 | 40 | 40 |
| Breaker cord | | | | |
| carbon content | 0.90 | 0.72 | 0.82 | 0.98 |
| Structure | 1 × 3 | 1 × 1 | 1 × 3 | 1 × 3 |
| Straight filament | | | | |
| Number of filament(s) | 0 | 0 | 2 | 0 |
| Diameter D (mm) | 0.2 | 0.45 | 0.27 | 0.17 |
| Tensile strength (N/sq.mm) | 4600 | 2800 | 3040 | 5000 |
| 2-D waved filament | | | | |
| Number of filament(s) | 3 | 1 | 1 | 3 |
| Diameter D (mm) | 0.2 | 0.45 | 0.27 | 0.17 |
| Tensile strength (N/sq.mm) | 4600 | 2800 | 3040 | 5000 |
| 2-D wave pitch P (mm) | 3.5 | 20 | 3.5 | 3.5 |
| 2-D wave height H (mm) | 0.15 | 0.18 | 0.15 | 0.15 |
| Final-twist pitch Pw (mm) | 15 | — | 15 | 15 |
| First-twist pitch Pn (mm) | 45 | — | 45 | 45 |
| Cord weight (gram/meter) | 0.74 | 1.26 | 1.35 | 0.54 |
| Elongation after fracture (%) | 4.2 | 2.2 | 1.9 | 3.2 |
| Tire weight (g) | −52 | 0 | +10 | −72 |
| Durability | 105 | 100 | 101 | 103 |

Form the test results, it was confirmed that by setting the tensile strength more than 4000 N/sq.mm, the quantity of steel in the cords necessary for reinforcing the breaker can be greatly reduced, and the weight of the tire can be greatly decreased, and by giving the specific two-dimensional waveform to the filament, the fatigue resistance can be increased to effectively improve the durability.

The filament having a tensile strength of more 5500 N/sq.mm was difficult to make and thus its production cost will be high.

As described above, in the metal cord according to the present invention, the filaments are greatly increased in the tensile strength and two-dimensionally waved to improve the fatigue resistance of the cord. Therefore, the weight of the cords required to reinforce a rubber article such as pneumatic tire can be reduced while maintaining or improving the durability. In comparison with three-dimensional waving such as spiral waving, two-dimensional waving is easy and the dimensional accuracy and stability are high. As a result, the cord can be made easier and the production cost may be lowered.

The present invention can be suitably applied to a pneumatic tire for not only passenger cars but also light trucks, recreational vehicles, truck/bus and the like.

In case of pneumatic tires, aside form the breaker cords, the metal cords according to the present invention can be used as band cords, carcass cords, bead reinforcing cords and the like. Further, aside from the pneumatic tires, the metal cord according to the present invention can be used to reinforce rubber articles which require a weight reduction.

What is claimed is:

1. A metal cord comprising filaments twisted together and each having a tensile strength of from 4000 to 5500 N/sq.mm and a diameter of from 0.10 to 0.35 mm, wherein said filaments are, before twisted, each two-dimensionally waved so that the elongation after fracture of the cord becomes in a range of from 2 to 6%, and said filaments are divided into a plurality of groups each including at least one filament, then the groups are final-twisted together while first-twisting each group, wherein the pitch of the final-twist is in a range of from 10 to 30 mm, and the pitch of the first-twist is in a range of from 1 to 20 times the pitch of the final-twist.

2. The metal cord according to claim 1, wherein the two-dimensional wave of the filament has a wave pitch of from 2.5 to 10.0 mm, and a wave height of from 0.1 to 0.5 mm.

3. The metal cord according to claim 1, wherein each said group includes at most four filaments.

4. The metal cord according to claim 1, wherein each said group includes at most four filaments, and said a plurality of groups are at most three groups.

5. The metal cord according to claim 1, wherein the pitch of the first-twist is more than the pitch of the final-twist.

6. A pneumatic tire including the metal cord according to claim 1, 2, 3, 4 or 5.

* * * * *